US005525208A

United States Patent [19]

Pritula et al.

[11] Patent Number: 5,525,208

[45] Date of Patent: Jun. 11, 1996

[54] GROUNDING ELECTRODE

[75] Inventors: Vsevolod V. Pritula; Rimma V. Kudinova, both of Moscow, Russian Federation; Igor D. Yagmur; Alexander V. Zuev, both of Donetsk, Ukraine; Alexander A. Delektorsky, Moscow, Russian Federation; Anatoly E. Kornev, Moscow, Russian Federation; Jury G. Nekljudov, Moscow, Russian Federation

[73] Assignee: N. V. Raychem S.A., Kessel-Lo, Belgium

[21] Appl. No.: 133,042

[22] PCT Filed: Apr. 15, 1991

[86] PCT No.: PCT/SU91/00068

§ 371 Date: Oct. 13, 1993

§ 102(e) Date: Oct. 13, 1993

[87] PCT Pub. No.: WO92/19793

PCT Pub. Date: Nov. 12, 1992

[51] Int. Cl.[6] ..... C23F 13/00

[52] U.S. Cl. ..... 205/724; 204/280; 204/294; 205/737; 205/739

[58] Field of Search ..... 204/147, 148, 204/196, 197

[56] References Cited

U.S. PATENT DOCUMENTS

| | | | |
|---|---|---|---|
| 3,326,791 | 6/1967 | Heuze | 204/196 |
| 3,332,867 | 7/1967 | Miller et al. | 204/197 |
| 3,726,812 | 4/1973 | Higashimura et al. | 252/521 |
| 4,267,029 | 5/1981 | Massarsky | 204/196 |
| 4,442,139 | 4/1984 | Brigham | 427/122 |
| 4,487,676 | 12/1984 | Parker et al. | 204/196 |
| 4,502,929 | 3/1985 | Stewart et al. | 204/147 |
| 4,526,666 | 7/1985 | Bianchi et al. | 204/196 |
| 4,642,202 | 2/1987 | Railsback | 252/511 |
| 4,786,388 | 11/1988 | Tatum, Jr. | 204/197 |
| 4,806,272 | 2/1989 | Wiley | 252/511 |
| 4,957,612 | 9/1990 | Stewart et al. | 204/196 |

FOREIGN PATENT DOCUMENTS

| | | |
|---|---|---|
| 0120148 | 10/1984 | European Pat. Off. . |
| 0210058 | 1/1987 | European Pat. Off. . |
| 50-40385 | 12/1975 | Japan . |
| 2100290 | 12/1982 | United Kingdom . |

*Primary Examiner*—T. Tung
*Attorney, Agent, or Firm*—Ladas & Parry

[57] ABSTRACT

A method for electric protection of a metal object, in which a long-line grounding electrode is installed in an electrolytic medium at a preset distance from the metal object to be protected and the metal object and the long-line grounding electrode are electrically connected to a current source to form a protection circuit, the metal object is polarized, while the sections of the electric connection and the geometric dimensions and/or electric parameters of the grounding electrode are so selected that the value of the current propagation constant in the protection circuit is less than or equal to $10^{-3}$ $m^{-1}$. The grounding electrode has an extended central flexible metal conductor (18), an adhesive layer (20) providing an electric contect, and an envelope (19) of a slightly soluble current-conductive material based on a composition including a carbon-containing filler in an amount of 40–80 wt. %, a rubber-base polymer in an amount of 10–49.8 wt. %, a plasticizer in an amount of 9–10 wt. % and an insecticide in an amount of 0.2–1.0 wt. %.

11 Claims, 4 Drawing Sheets

GROUNDING ELECTRODE

FIELD OF THE INVENTION

The invention relates to electric protection of various objects, and, more specifically, to methods for electric protection of a metal object, grounding electrodes for effecting the method and compositions for the grounding electrodes.

The invention can be used in systems of anti-corrosion cathodic protection of elongated metal structures, for example, underground main pipelines, as well as for electric protection of metal objects, including those of a complex shape, from external voltages.

BACKGROUND ART

Known in the art is a method for anti-corrosion cathodic protection of an elongated metal object, in which a long-line anode in the form of a continuous flexible steel core in an electrically conductive polymer envelope is installed in an electrolytic medium near the surface to be protected. In this case, the anode is disposed along the object at a pre-set distance therefrom determined by the thickness of the electric insulation plate between the anode and the surface to be protected, then the object and anode are connected to a polarizing current source (U.S. Pat. No. 4,487,676).

This known method however has a number of significant drawbacks. Thus, the anode is disposed in the immediate vicinity of the surface to be protected, the distance between them is hot optimized with respect to the electrical characteristics of the whole system. This fact, even in the case of a plane-parallel electric field, reduces the protection and results in nonuniform distribution of potential, especially with aged insulation.

Furthermore, the prior art method of disposition of the protective grounding (anode) is associated with a danger of over-protection at the drain point, i.e. there is a danger that the whole protection system will more rapidly fail.

Attempts to avoid over-protection by reducing the potential have resulted in reduction of the protection zone, i.e. impairment of the protection efficiency as a whole.

Known in the art is a method of cathodic protection of extended objects by means of a flexible long-line anode, which provides an optimum distance between the anode and the surface to be protected. The known method includes installation of a long-line anode in the form of a continuous flexible metal core encased by an electrically conductive flexible polymer envelope in contact therewith and installed in an electrolytic medium at a preset distance from the object, connection of this object and anode to current sources and polarization of the object from the anode. According to this method, the anode material resistance must be within 0.1 to 1000 ohm cm, while its longitudinal resistance must not exceed 0.03 to 0.003 ohm m. In so doing, the anode must be arranged relative to the object to be protected so as to keep a ratio $(b+D)/(a+D)<2$, where a is the minimum distance between the anode and the object to be protected, b is the maximum distance between the anode and the object to be protected and D is the maximum linear size of the object to be protected in the direction normal to the anode axis (U.S. Pat. No. 4,502,929).

This method is still characterized by some drawbacks hindering its application. For example, the known method does not provide needed uniformity of distribution of the protective difference of potentials along the circumference of the insulated pipe in the process of long-term operation. A similar negative result occurs when the pipe surface has no installation. This is due to the fact that the protective difference of potentials includes both the pipe potential proper determined by the integral value of the linear density of the polarizing current and the potential of the surrounding medium depending on the differential densities of the current flowing at each point of the volume of the current-conductive space. Under otherwise equal conditions, the latter is substantially determined from not only the ratio of the distances between the anode and the object to be protected and the linear size of the latter but also depends on the disposition of damage and discontinuities in the insulation along the pipe circumference and the electrochemical properties of the surrounding ground.

In many cases, with the ratio $(b+D)/(a+D)<2$, it is not possible to ensure the required level of protection over the whole surface, e.g. a single cross-section of a pipeline. Indeed, in the case of cathodic protection of adjacent sections of a pipeline 1400 mm in diameter with an insulation resistance of 300 ohm m and 1000 ohm m the ratio of the densities of the cathodic polarizable current must meet the ratio of 3:1 in order to provide a uniform protective potential. In this case the potentials of the nearest point of the ground near the pipeline with the same departure of the anode will also meet this ratio. Assuming that $b \ll D$ and $a \ll D$ under condition that $b/a<2$, it is impossible to compensate the nonuniformity of the potentials of the ground points and, therefore, also the level of protection of adjacent sections characterized by $K=3$.

A similar situation is valid when a homogeneous section of a pipeline is to be protected. In this version the ground potential at the near and remote generatrix lines of the pipe remains nonuniform and this results in nonuniformity of distribution of the protective potential difference over the circumference and reduces the level of protection. The limited ratio does not allow this nonuniformity to be avoided because for pipelines under the condition that $b-a=D$ it assumes a form of $a/D>0$, which makes the condition of attaining uniformity of the level of protection indefinite.

The field of application of the method is also limited by the predetermined therein ranges of the resistance of the anode material, as well as that of the structure as a whole. In these ranges the anode cross section (taking no account of the flexible core) must be at least 0.33–333 $m^2$ (with a diameter of 0.63–18.3 m), and this is completely unreal. If no account is taken of the limiting values of the longitudinal resistance of the core (0.03 to 0.0003 ohm cm) specified in the description, its diameter should be in the range of 0.9 to 8.7 mm which is also unlikely taking into account the technology of manufacture and application of the anode, since this makes it less strong or flexible.

Since the attainment of a required level of protection depends in general on the absolute value of the protection current and the rate of attentuation of the current along the anode, the application of the prior art method can be inefficient in high-resistance grounds due to an increase of the input resistance of the anode or in connection with good condition of the insulation coating of the object to be protected. In these cases, it will be impossible to obtain the required value of the protection current due to the high contact resistance of the anode and distribution of the required density of the protection current due to a high value of the constant of propagation of the current along the anode. Both these factors essentially limit the field of effective application of the known extended anodes in general and of the above method in particular.

Taking into account the peculiarities of the electrochemical processes taking place in ground electrolytes, the basic requirements to the grounding electrodes are their low rate of solubility, particularly of the anode, flow resistance to the current flow and uniform current yield of the working surface of the electrode. The fulfillment of the above requirements provides longevity and operational efficiency of the electrode. At the same time, conditions of cyclic transportation and assembly loads require that the electrodes should have as much flexibility and elasticity as possible to enhance their operational reliability.

With cathodic protection of extended structures the design of cable type electrodes (extended electrodes) are advantageous over pin type electrodes since the current yield of the extended electrodes is effected in a plane-parallel field providing high efficiency of the protection.

Known in the art is a grounding electrode used in cathodic protection systems which is made in the form of a plurality of working elements (iron-silicon anodes) distributed along a current-conducting power cable and electrically connected thereto by contact units of a special design providing continuity of the cable and monolithic structure of the electrode as a whole. Each working element of the electrode comprises a body with a central hole having a conical section, a continuous power cable put through the hole in the electrode body and a means for fixing the electrode body to the cable and simultaneously providing an electric contact therewith. The means for fixing and electric contact is made in the form of two semi-envelopes encompassing the cable and disposed in the hole of the electrode body. The semi-envelopes have a central portion made of an electrically conductive material in direct contact with the bare cable and two end conical sleeves made of an elastic dielectric material. The semi-envelopes of the fixing means are distributed in pairs along the cable axis and form a monolithic connection of the electrode elements using the wedge method (U.S. Pat. No. 3,326,791).

The use of iron-silicon anodes as working elements leads to electrode brittleness and significant losses during transportation and assembly.

The contact units with conical dielectric sleeves do not provide reliable enough contact due to their possible mechanical deformation during transportation and assembly. In addition, such units do not allow protection of the current-conductive cable against direct electric contact with an electromagnetic medium and this results in premature destruction of the electrode and its failure. As a result the life of such electrodes is short.

Known in the art is a flexible extended anode for cathodic protection against corrosion of the internal surface of a tank made of a magnetically perceptive metal with an electrolytic medium. The anode comprises at least one steel mainline conductor, a flexible extended envelope made of an electrically-conductive polymer encompassing the conductor and having an electric contact with it, and a flexible dielectric layer of a magnetic material (permanent magnet) connected along the anode axis with the envelope mechanically or through an adhesive layer.

The magnetic dielectric layer maintains the anode near the surface to be protected but excludes its electric contact with the envelope. A layer of porous material (additional porous envelope) is disposed between the electrically conductive polymer envelope of the anode (U.S. Pat. No. 4,487,676).

The known anode does not allow the current distribution to be controlled when protecting tanks or other objects of a similar shape, i.e. with discretely differential quality of the surface state. The anode is limited along the length of the protection zone due to non-compensated attenuation of the current in the monolithic electrically-conductive envelope and is limited by zone of protective effect (on both sides of the anode) due to the disposition of the anode directly on the surface to be protected as is necessary for the magnetic dielectric layer. In connection with these drawbacks, in order to guarantee a required level of protection over the entire surface to be protected, the anode must operate under high current loads which results in premature wear and consequently in a reduction of service life.

The solution which is closest to the claimed one in its technical essence is an extended flexible electrode of an electrically-conductive polymer composition used in systems of cathodic protection of metal objects, e.g. pipelines. The electrode is made in the form of a band and comprises an extended flexible metal core and an evelope of an electrically-conductive polymer based on thermoelastoplastic materials or plastic materials of the polyvinyl chloride type encompassing the core in electric contact therewith and forming a working, electrochemically active surface of the electrode. The electrode may be disposed in an additional external dielectric electrolytically impermeable envelope preventing direct contact of the electrode working surface with the object surface (GB, A, 2,100,290).

The electrode does not have adequate reliability, especially during assembly due to its low elasticity and frost resistance, since at a temperature of below −10° to −15° C. the envelope material starts cracking. These properties of the electrode also have an adverse effect on its life. In addition, the electrode life is low due to its liability to biological destruction due to a low content of a filler in the envelope material; rapid workout of the filler opens access of the elctrolyte to the core, which results in accelerated work-out, which is also a result of a low content of plasticizer (washing out of the plasticizer and quick cracking of the electrode envelope) caused by low material capacity of the thermoelastoplastic materials and plastics used in the envelope material.

Furthermore, the electrode design permits use of a current-conductive core with a rated resistance of 0.5 ohm $mm^2/m$ (for comparison, the resistance of a copper core is 0.018 ohm $mm^2/m$ while that of the steel core is 0.24 ohm $mm^2/m$). This requires a minimum diameter of 4.5 mm with the worst permissible resistance of 0.03 ohm/m. At the same time, the realization of the best resistance of 0.0003 ohm/m is practically impossible since it is realizable with a diameter of 45 mm. At the same time, the resistance of the material of the polymer envelope does not exceed 10 ohm m. This does not make it possible to completely utilize the advantages of the extended electrode provided by its constant current attenuation whose minimum value is 5.5 $10^{-3}$ l/m. Under such conditions the current load on the electrode increases, especially near the point of its connection and this also reduces the electrode life.

The electrically-conductive polymer compositions and electric devices built around them are well known in the art. The main components of such compositions are carbon-containing fillers (elementary carbon) and a polymer matrix or binder while the properties of each composition are modified by introducing various additives depending on the designation and conditions of application of the composition (U.S. Pat. No. 4,442,139).

The main requirements to the composition for grounding electrodes consist of high electrical conductivity and low rate of solubility in an electrolytic medium. The conditions of transportation and storage as well as the technology of assembly of the grounding electrodes require their high elasticity.

With respect to the elasticity characteristic the electrodes based on electrically-conductive polymers are advantageous over for example electrodes based on metal-oxide or iron-silicon mass used in cathodic protection of metal structures.

However, stable combination of a high elasticity index (minimum 10%) with optimum for the given type of electrolyte (e.g. ground) indexes of electrical conductivity and solubility (in particular, anode) is a complex technical problem.

An electrically-conductive composition is known having high electrical conductivity which comprises an electrically-conductive filler (metal powder plus gas soot) and a dispersing component somewhat compatible with rubber, e.g. polyvinyl chloride, polystyrene, nylon, polyethylene glycol taken in a weight ratio 40–60 and 60–40 respectively to form a mixture with an elastomer binder such as natural rubber, polybutadiene, polyisoprene, ethylene-propylene rubber copolymers. The ratio of the filler with a dispersing agent and a rubber base of the matrix in the composition is from 1.1:1 to 5:1 (U.S. Pat. No. 4,642,202).

The known composition has a specific resistance less than $10^6$ ohm cm with low concentrations of the electrically-conductive filler.

However, from the point of view of its possible application for grounding electrodes, in particular, for the anode grounders in the system of cathodic protection, it has a number of significant drawbacks. First, the plastics, like polyvinyl chloride and polystyrene, included in the composition feature reversibility of deformation, which makes the composition inadequately elastic, particularly at low temperatures. Furthermore, the compositions based on plastic materials of the polyvinyl chloride type have low solid matter content, i.e. low filler content. On the other hand, the metal powder-filler causes drastic oxidation of the polymer, particularly under the effect of the applied current, and this leads to cracking of the polymer and to loss of elasticity.

The electrolyte penetrating through the pores and microscopic cracks causes dissolving of the metal and fast wash-out of the filler, which with a low content of the latter drastically changes the electrical characteristics of the composition. Thus, the metal filler in the polymer matrix used for the known composition contributes to a rapid increase of the specific resistance of the composition in the electrolytic medium and stipulates its instability to anode dissolution. As a result, the insufficient vibration and frost resistance, as well as the low flexibility of the material based on the known composition make it practically inapplicable for the grounding electrode.

Known in the art is an electrolytic composition for coating extended conductors which comprises in weight per cent: electrically-conductive filler (calcined coke) 5–7%; polymer binder (ethyl lithacrylate and other acryl-latex polymers in emulsions) 5–50%; water-based solvent 5–50%; surface-active additive 0–5%; thickener 0.1–10%: alcohols $C_3$–$C_{12}$ 0.01– 2.5%; a compound containing a bacterial anti-corrosion protective substance and fungicides 0.01–2.5% (U.S. Pat. No. 4,806,272).

The composition is used in the form of an electrically-conductive coating for cathodic protection against corrosion of steel structure of reinforced concrete members.

However, the known composition has inadequate electrical conductivity and low resistance to anode dissolving due to weak hydrolytic stability of carboxyl groups, their liability to moisture absorption and this increases the anode dissolution. Thus, the life of the coating based on the known comsition is low. In addition, the coating based on the known composition has insufficient elasticity due to inadequate elasticity of the acrylates and the absence of reaction of the coke with a polymer of the acrylate type.

The known composition can be used only in the form of an anode layer on a cathode polymerizable structure and cannot be made in the form of grounding electrodes of the pin or cable type using traditional process equipment, and this limits the field of applciation of the composition and makes it unsuitable for protection of elongated underground metal structures.

The closest in technical essence to the claimed composition is that for a long-line flexible electrode used in systems for anti-corrosion cathodic protection of metal objects, e.g. pipelines. The composition comprises the following components in wt. %: an electrically-conductive filler (gas soot or graphite) 23–55; a polymer binder (thermoplastic polymer, polyvinyl isenfluoride and acryl resin, chlorinated polyethylene) 65–44.8; additives (antioxidant, calcium carbonate) 0.1–5.0. The specific resistance of the composition is 0.6–29 ohm cm at 23° C., its relative elongation is 10% (GB, A, 2100290).

From the point of view of possible application of the known composition in grounding electrodes for cathodic protection of underground structures, it has a number of drawbacks. In the first place, this composition has low resistance to anode dissolution due to the tendency of hydrolysis of the components such as chlorinated polyethylene, polyvinylidene fluoride used in its binding matrix, and, therefore, moisture saturation in the composition material under the effect of ground electrolytes. In the second place, the plastic materials which are the base of its polymer matrix are not material consuming, i.e. the filler content is limited. As an inevitable result, the filler is washed out and this drastically increases the specific resistance of the composition, i.e. the necessary electrical characteristics of the protection circuit will be lost. In addition, the field of application of the known composition is limited due to its frost resistance. The low frost resistance is due to the fact that in all embodiments of the composition its binding matrix includes a polymer component (thermoplastic polymer, chloride or fluoride) comprising polymer links which have an elevated crystallization temeprature. Thus, the strength and electrical characteristics of the composition drastically deteriorate at low temperatures.

A significant drawback is also low plasticity of the composition (relative elongation is equal to 10%) and, therefore, low flexibility and low fatigue strength of the composition material. Electrodes based on the known composition have low resistance to cyclic strains which always occur during transportation and assembly.

DISCLOSURE OF THE INVENTION

The basic object of the invention is to provide a method for electric protection of a metal object, a grounding electrode used therein and a composition for the grounding electrode which would increase the term of protective effect of the grounding electrode due to a decrease of the resistance to grounding electrode current spread, uniform distribution of its potentional, lower solubility and higher frost resistance of the grounding electrode.

This object is attained in a method for electric protection of a metal object, in which a long-line grounding electrode comprising a central flexible metal conductor and an envelope encompassing the central conductor and made of slightly soluble polymer electro-conductive material is installed in an electrolytic medium at a preset distance from the metal object to be protected, the metal object to be protected and the grounding electrode are electrically connected to a current source to form a protection circuit and the metal object is polarized, in that according to the invention, sections of the electric connection to the current sources of the long-line grounding electrode and the metal object to be protected, as well as the geometric dimensions and/or electrical parameters of the long-line grounding electrode are so selected that the value of the current propagation constant in the protection circuit is less than or equal to $10^{-3}m^{-1}$.

During realization of cathodic protection of a metal object at least one additional current source may be provided, all current sources being connected to the long-line grounding electrode at intervals along its length at which a current attenuation index less than or equal to 1.5 is attained in the protection circuit.

The object of the invention is also attained due to the fact that in the grounding electrode comprising an extended central flexible metal conductor and an envelope encompassing the central conductor and made of slightly soluble polymeric electro-conductive material, according to the invention, an adhesive layer ensuring an electric contact is provided on the central conductor.

An electrically-conductive adhesive layer with electronic conductivity is arranged between the envelope and the central conductor.

It is preferable that the envelope be made of two layers and the electrical conductivity of the layers different, and also that the envelope has electrical parameters varying along the length of the electrode.

It is also preferable that the adhesive layer has electrical parameters varying along the electrode length when the central conductor is multiple-core and surrounded by a common adhesive layer or each wire is encompassed by an adhesive layer.

It is also expedient that the flexible envelope is provided on at least a portion of the central conductor and forms individual sections on the whole grounding electrode, in which case the sections of the grounding electrode free from the flexible envelope have an electrically insulating layer and are conjugated with the sections having the flexible envelope through a sleeve of a dielectric material surrounded by a part of the flexible envelope to form a monolithic joint; the dielectric material of the sleeve, the flexible envelope material and the material of the electrically insulating layer are preferably selected so that they have similar thermodynamic properties.

Each wire of the multiple-core central conductro may have sections provided with an electrically insulating layer sections having no electrically insulating layer, while the flexible envelope may encompass all sections having no electrically insulating layer, whcih are conjugated with the sections of the respective sire provided with the electrically insulating layer through a sleeve of a dielectric material surrounded by a portion of the flexible envelope to form a monolithic joint.

When the device is used for cathodic protection of a metal object, each wire of the multiple-core central conductor may be connected to its own current source belonging to an independent protection circuit.

It is desirable that at least for one wire the ratio of the length of the section having an electrically insulating layer to the cross-sectional area of the wire at this section varies along the length of the grounding electrode.

The object of the invention is also attained due to the fact that the composition for the grounding electrode containing a carbon-containing filler and a binder, according to the invention, comprises a rubber-based polymer as the binder and also a plasticizer and an insecticide with the following ratio of the components in wt. %:

| | |
|---|---|
| carbon-containing filler | 40–80 |
| rubber-based polymer | 10–49.8 |
| plasticizer | 9–10 |
| insecticide | 0.2–1.0 |

It is advisable that the composition includes a structure stabilizer in an amount of up to 10 wt. % of the amount of the rubber-based material.

The rubber-based polymer may consist of polychloroprene or butyl rubber, or synthetic ethylene-propylene rubber while the plasticizer may consist of dibutyl phthalate or Vaseline oil or rubrax; the insecticide may consist of thiurams or carbamates or chlorophenols, while the structure stabilizer may consist of a mixture of magnesium chlorides and calcium chlorides or silica gel or calcined magnesia.

The proposed invention makes it possible to increase the longevity of the protective action of the grounding electrode, reduce the resistance to the spread of the grounding electrode current, increase the uniformity of distribution of its potential, decrease the solubility and increase the frost resistance of the grounding electrode.

BRIEF DESCRIPTION OF THE DRAWINGS

The invention is further described by way of example with reference to the accompanying drawings, in which.

BEST METHOD OF CARRYING OUT THE INVENTION

Figure 1:
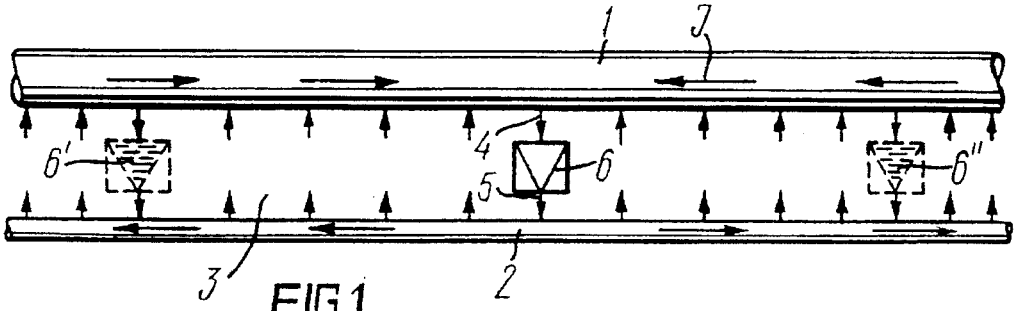
FIG. 1 shows a schematic diagram of realization of the method for electric protection of a metal object, according to the invention.

The method for electric protection of a metal object is considered using an example of protection of a pipeline 1 (FIG. 1) with the utilization of a long-line grounding electrode 2, which is put into an electrolytic medium 3, e.g. in the ground, at a preset distance from the pipeline 1 to be protected.

The pipeline 1 through a conductor 4 and the electrode 2 through a conductor 5 are connected to a current source 6 to form a protection circuit, whereupon the pipeline 1 is polarized.

The source 6 has its negative terminal connected to the pipeline 1 and the positive terminal connected to the electrode 2. As a result, during the operation a protection current I constantly flows, the direction of this current being shown by arrows 7. In so doing, the section of connection of the pipeline 1 and electrode 2 to the current source 6, as well as the geometric dimensions and/or electrical parameters of the electrode are so selected that the value of the constant $\alpha$ of propagation of the current in the protection circuit is less than or equal to $10^{-3}$ $m^{-1}$. This value of the current propagation constant $\alpha$ must not exceed the above value since in this case the rate of attenuation of the current in the electrode increases to such a degree that practically excludes all advantages of current distribution and current yield typical to the long-line electrode.

Depending on the above conditions, the current source 6 can be located on any section of the grounding electrode 2, as shown in FIG. 1 which conditionally shows the disposition of the source 6' or 6" nearer the beginning and end of the pipeline 1.

Figure 2:
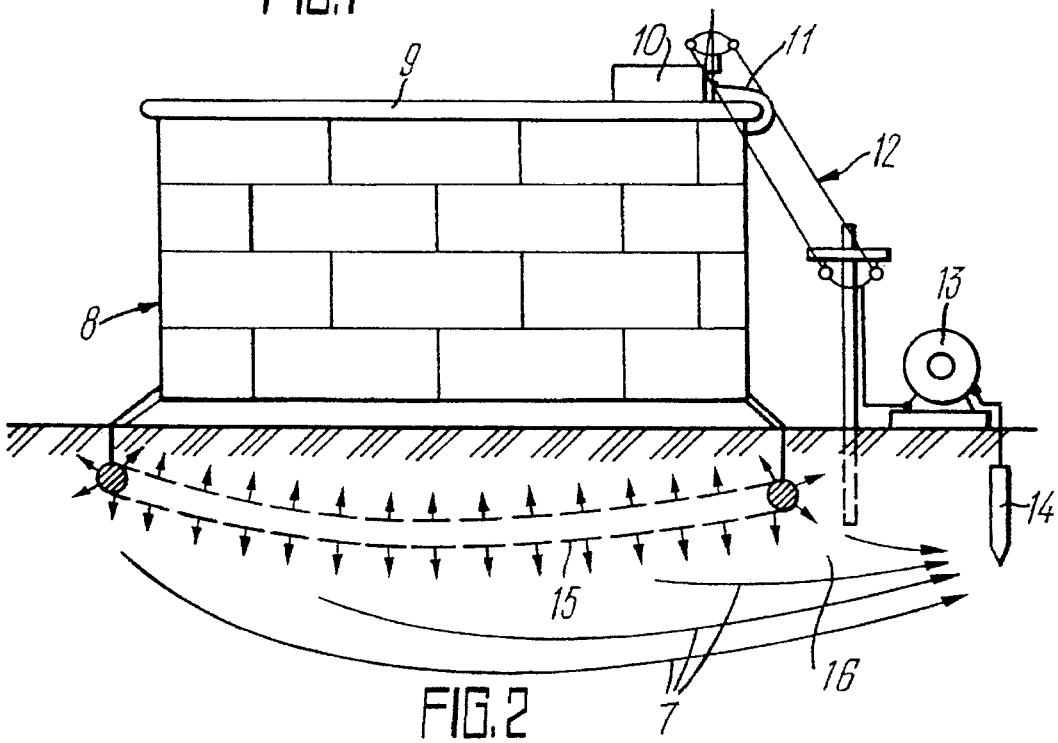
FIG. 2 shows a schematic diagram of realization of the method for electric protection of a reservoir, according to the invention.

FIG. 2 shows a diagram of effecting the method for electric protection of a reservoir 8 having a roof 9 which is made of dielectric material and carries a control unit 10 connected to the body of the reservoir 8 through a conductor 11 and to a current source 13 through wires 12. The body of the current source 13 is in turn also grounded by means of an electrode 14. The reservoir 8 is surrounded by a long-line grounding electrode 15 electrically connected to the body of the reservoir 8.

In case of breakdown of the insulation and appearance of a voltage on the body of the unit 10, this voltage through the wires 12 and the body of the reservoir 8 is applied to the protective grounding of the long-line electrode 15 through which the protection current 7 flows through ground 16 to the electrode 14 of the working grounding of the source 13 and the protection circuit is closed at the source 13.

Figure 3:
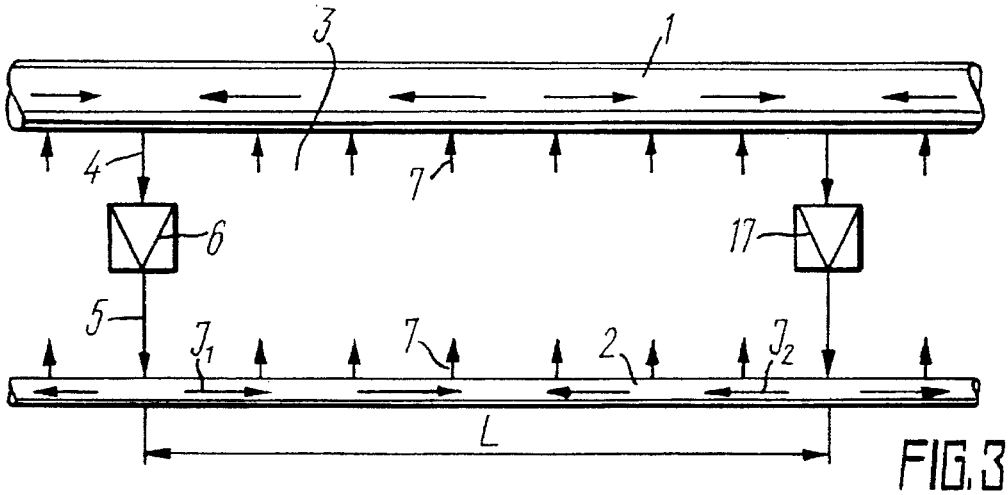
FIG. 3 is the same as shown in FIG. 1 but with several current sources, according to the invention.

FIG. 3 shows an embodiment of effecting the method for cathodic protection of the pipeline 1 with two current sources 6 and 17, which are electrically connected both to the pipeline 1 and to the grounding electrode 2 in a manner similar to the conenction of the source 6 in the circuit shown in FIG. 1. The direction of flow of the protection currents $I_1$ and $I_2$ (FIG. 3) from the sources 6 and 17 is shown by arrows 7. In this case, the most efficient version of the cathodic protection depends on the correct selection of the distance L between the sources 6 and 17, which must be such as to provide a needed index of the current attenuation in the protection circuit, i.e. the product $\alpha$ L less than or equal to 1.5. If the current attenuation index exceeds 1.5, the rate of current attenuation in the protection circuit increases to such a degree that the electrode stops performing its protective functions over the whole section of length L.

The continuous flexible extended anode is disposed at a constant distance from the surface to be protected to form a plane-parallel field of the cathode current and additional limitations are introduced which practically level out the difference of potentials of the electrically-conductive medium, e.g. ground, disposed around the pipeline to be protected.

It has been found in practice that under the conditions of the plane-parallel field of the current appearing with cathodic protection using a flexible extended anode, such a limiting condition is the relationship $a > \xi D$ [1], where a is the minimum distance between the anode and the object to be protected, D is the maximum size of the object, $\xi$ is an empirical correlation coefficient. The observance of this relationship practically eliminates the nonunformity of the protective difference of the potentials of the structure resulting from the shielding effect.

To increase the strength and flexibility of the long-line electrode 2 and to expand the field of its utilization when the transient and input resistances are increased, a limiting ratio is introduced for the operation of selection of the electrode and its connection through the current source 6 to the pipeline to be protected.

$$\alpha_1 \leqq 10\alpha_2 \qquad [2]$$

where $\alpha_1$, $\alpha_2$ are the current propagation constants between the points of connection of an anode grounding 25 and an object 23 to be protected, respectively.

Satisfying the relationships [1], [2], e.g. by among other ways, laying two anode groundings connected to the current source 6, the rates of the current attenuation along the grounding and the object 1 to be protected are made close, thus increasing the level of efficient protection and expanding the field of use of the grounding in high-resistance grounds due to maximum utilization of the properties of the long-line electrode 2, taking into account the current, relating to reducing the input resistance in the protection circuit by increasing the current flow interval while preserving allowable loss of its density due to attenuation.

As an example, let consideration be given to serveral embodiments of cathodic protection of a section of a pipeline 320 mm in diameter with a branch of a complex configuration of a total length of 15.5 km being in operation for 15 years and having a corrosion potential of 0.4 V m.s.e. (eith an average specific resistance of the ground equal to 30 or 100 ohm m). To provide the required level of protection use was made of two kinds of connection of protective systems compensating the phenomena of interference and shielding with two and four current sources. According to the basic methods of calculation, such sources must have maximum output power of 300 W. They must be equipped with concentrated anode groundings disposed, respectively 150 or 100 m from the pipeline and consisting, respectively, of 28–100 or 56–200 electrodes. To provide the required operating modes of the sources, 250 or 80 W of electric energy is required respectively per year.

Various embodiments may be used in the case of using the circuits for connection of protection systems with a long-line grounding electrode 2. Consideration will be given to the following embodiments: (1) the known method of connection while fulfilling the ratio (b+ D)/(a+ D)< 2, where b is the minimum distance between the anode and the object to be protected; (2) the same, equivalent to the condition of $\alpha_a<11\alpha_o$; (3) the same, equivalent to the condition of a<4.5D; (4) with observance of the ratio (b+D)/(a+D)=3; (5) with observance of-the ratio (b+D)/(a+D)<3; (6) with observance of the relationship $\alpha_a=10\alpha_o$; (7) with observance of the relationship $\alpha_a<10\alpha_o$; (8) with observance of the relationship a=5D; (9) with observance of the relationship a< 6D.

The main working characteristics of the above-discussed circuits of connection of protective systems with different anode groundings to provide an adequate level of protective potentials are given in Table 1.

TABLE 1

| System parameters | | Versions of cathodic protection circuits with long-line anode groundings | | | | | | | | | Versions of cathodic protection circuits: with two sources with concentrated anode groundings | | Versions of cathodic protection circuits: with four sources with concentrated anode groundings | |
|---|---|---|---|---|---|---|---|---|---|---|---|---|---|---|
| | | 1 | 2 | 3 | 4 | 5 | 6 | 7 | 8 | 9 | | | | |
| 1 | | 2 | 3 | 4 | 5 | 6 | 7 | 8 | 9 | 10 | 11 | | 12 | |
| Specific resistance of ground, ohm m | | 30 | 100 | 30 | 30 | 30 | 30 | 30 | 100 | 100 | 30 | 100 | 30 | 100 |
| Number of sources, units | | 100 | 60 | 30 | 10 | 10 | 4 | 4 | 8 | 8 | 2 | 2 | 4 | 4 |
| Composition of anode grounding | Number of electrodes units | — | — | — | — | — | — | — | — | — | 28 | 100 | 56 | 200 |
| | Cable length, km | 17.65 | 15.5 | 15.5 | 15.5 | 15.5 | 15.5 | 15.5 | 15.5 | 15.5 | — | — | — | — |
| Length of connecting cable, m | | 200 | 120 | 120 | 20 | 40 | 8 | 8 | 8 | 16 | 300 | 300 | 400 | 400 |
| Annual consumption of electric energy, kW | | 0.03 | 0.054 | 0.03 | 0.33 | 0.33 | 0.4 | 0.2 | 0.26 | 0.26 | 0.25 | 0.25 | 0.08 | 0.08 |

As seen from Table 1, the best results, as compared with the prior art method, are obtained using the embodiments according to the proposed method, i.e. with a long-line anode grounding characterized by the relationships:

$$\frac{b+D}{a+D} \leqq 3;\ a=5\,D;\ \ \alpha_o \leqq 10\,\alpha_o$$

Therefore, the enhancement of the level of protection of objects and expansion of the field of utilization of the method are attained by using its technical advantages consisting of an increase in the uniformity of distribution of the protective potential and higher efficiency, as well as a reduction of the input resistance of the grounding electrode due to the optimum distance between the electrode and the object to be protected and the electrical characteristics of the grounding.

Figure 4:
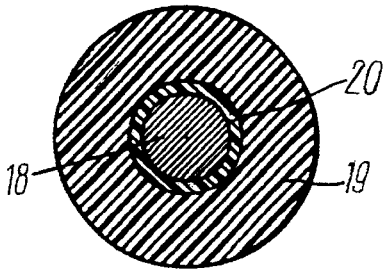
FIG. 4 is a cross-sectional view of the grounding electrode according to the invention.

The grounding electrode used in the above-described method for electric protection of metal objects comprises an extended central flexible metal conductor 18 (FIG. 4) and an envelope 19 encompassing the conductor 18 and made of a flexible slightly soluble polymer current-conductive material. An adhesive layer 20 providing an electric contact between the envelope 19 and the conductor 18 is applied onto the conductor 18.

The adhesive layer 20 is electrically conductive, made, for example, of an electrically-conductive enamel or an electrically-conductive adhesive; the adhesive layer 20 seals the conductor 18 and the contact joint between the conductor 18 and the envelope 19.

Figure 5:
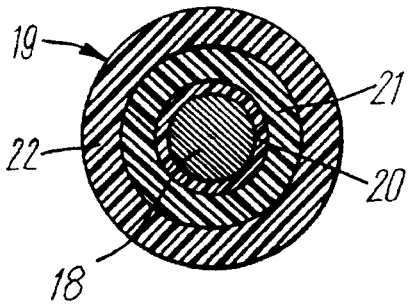
FIG. 5 is a cross-sectional view of the same electrode with a multiple-layer envelope, according to the invention.

The envelope 19 (FIG. 5) is made two-layer and different electrical conduction of the layers 21 and 22 is provided. The envelope 19 has varying electrical parameters along the length of the electrode. This is attained by proper selection of the concentration of the carbon-containing filler in the composition from which the envelope 19 is made; this permits the distribution of the protection current to be controlled, thus ensuring the differential density of the protection current as necessary for different sections of the object to be protected.

The adhesive layer 20 along the electrode can also have varying electrical parameters, which is attained due to the variable concentration of the electrically-conductive filler of the layer and enables the electrical characteristics of the electrode to be controlled.

Figure 6:
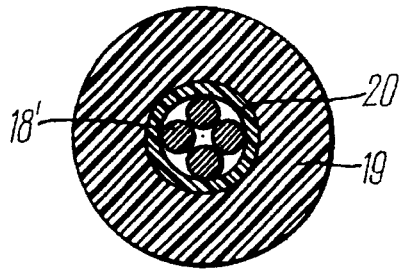
FIG. 6 is a cross-sectional view of the same electrode with a multiple-core central conductor, according to the invention.
Figure 7:
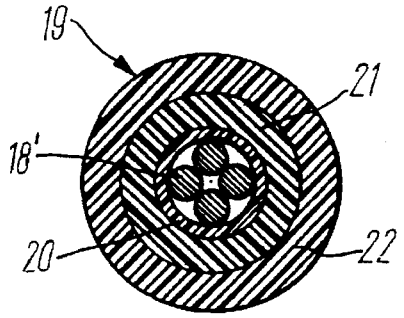
FIG. 7 is a cross-sectional view of the same electrode with a multiple-core central conductor in another embodiment according to the invention.

FIG. 6 shows an embodiment of the central conductor 18' made as a multiple-core cable, while the adhesive layer 20 surrounds the whole conductor 18, in which case the envelope 19 is made as single-layer, as shown in FIG. 6, or two-layer, as shown in FIG. 7.

Figure 8:
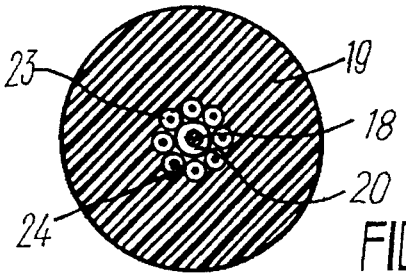
FIG. 8 is a cross-sectional view of another embodiment of the electrode, according to the invention.

The multiple-core conductors 18 may be made differently. In FIG. 8 the central conductor 18 with an adhesive layer 20 is surrounded by a plurality of wires 23, each of which is encompassed by its own adhesive layer 24. The plurality of wires 23 are in turn surrounded by a flexible envelope 19.

Figure 9:
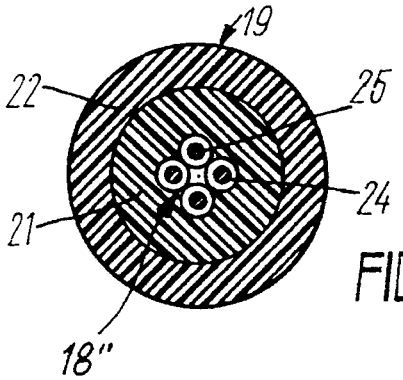
FIG. 9 is a cross-sectional view of the same electrode with a two-layer envelope and a multiple-core central conductor, according to the invention.

FIG. 9 shows an embodiment of the electrode, in which the central conductor 18" comprises several wires 25, each of which is encompassed by its own adhesive layer 24. The central conductor 18" is surrounded by an envelope 19 made of two layers 21 and 22 each having different electrical conductivity properties (as in the embodiment described with reference to FIG. 5).

Such embodiments of the electrode make it possible to use it as a working member of the grounding whereby a reliable contact is ensured between the electrode and the current-carrying main conductor (on the internal surface), isolation of the main conductor from the ambient medium and uniform flow of the anode current along the whole length of the grounding taking into account the variable conduction of the envelope along its length The above-described construction ensures the following properties of the grounding:

drastically reduces the number of contact units and eliminates their contact with the ambient medium which enhances the reliability of the construction;

considerable reduces the resistance of the grounding in high-resistance ground, since it consists of a linear long-line electrode with current leakage;

stabilizes the resistance of the grounding in time since it reduces the electrodynamic removal of moisture due to reduction of the anode density of the current at each point of the surface of the grounding electrode;

ensures uniformtiy of distribution of the protection current and potential along the object to be protected due to variably differentiated conduction of the electrically-conductive electrode envelope.

Figure 10:
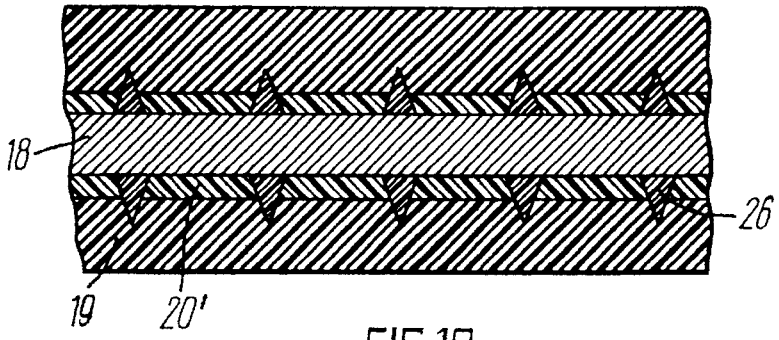
FIG. 10 is a longitudinal sectional view of an embodiment of a grounding electrode with pins on the central conductor, according to the invention.

In order to provide an electric contact of the central conductor 18 with the envelope 19 when the adhesive layer is a dielectric, the central conductor 18 has a plurality of pins 26 (FIG. 10) which penetrate into the envelope 19 through the adhesive layer 20'. The flexible envelope 19 is provided on only a portion of the length of the electrode. In the embodiment illustrated in FIG. 11, the conductor 18 has three successive sections consisting of end sections 27 and central section 28. The flexible envelope 19 of a conductive polymeric material surrounds both end sections 27 and central section 28. Around sections 27, the conductive polymeric envelope 19 is radially separated from the sections 27 of conductor 18 by a sleeve 30 of dielectric material, e.g. of chlorosulphonated polyethylene or a copolymer of a butadiene and styrene-lithel styrene. The sleeve 30 forms a monolithic joint with the envelope 19 surrounding it.

The sleeve 30, envelope 19 and electrically insulating layer 29 are made of materials which are selected so that they have thermodynamic similarity. For example, this is the following combination of materials: 1) the envelope 19—cis-1,4-polyisoprene rubber with a carbon-containing filler, sleeve 30—a copolymer of butadiene and styrene, insulating layer 29—polybutadiene; 2) the envelope 13—polychloroprene, sleeve 30—chlorosulphated polyethylene, insulating layer 29—a copolymer of butadiene and nitryl-acrylic acid.

Figure 12:
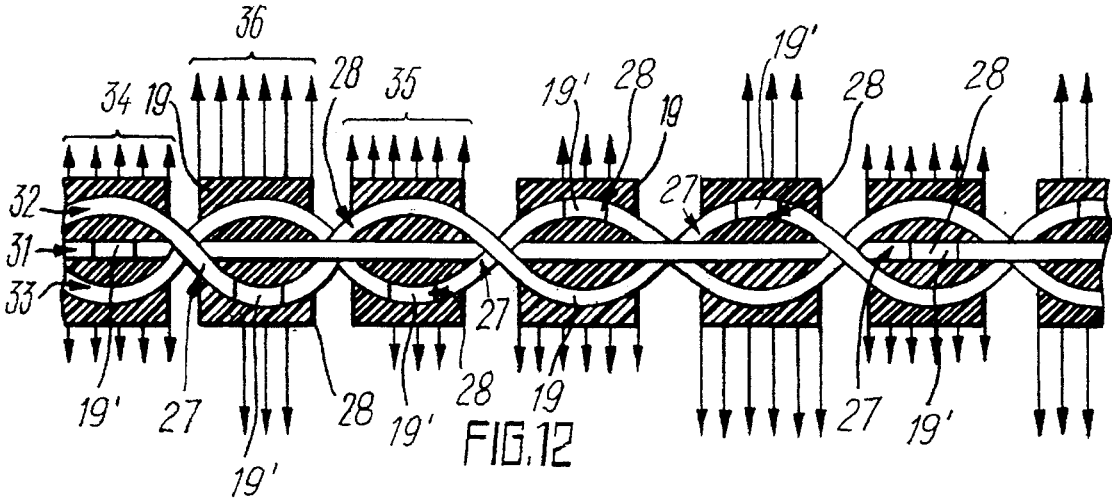
FIG. 12 is a longitudinal sectional view of an embodiment of the grounding electrode with a multiple-core central conductor, according to the invention.

To increase the operating life of the anode grounding, a preset alternation of the density of the leakage current of individual sections is provided by using anode grounding of several similarly made grounding electrodes 31, 32 and 33 (FIG. 12).

Figure 11:
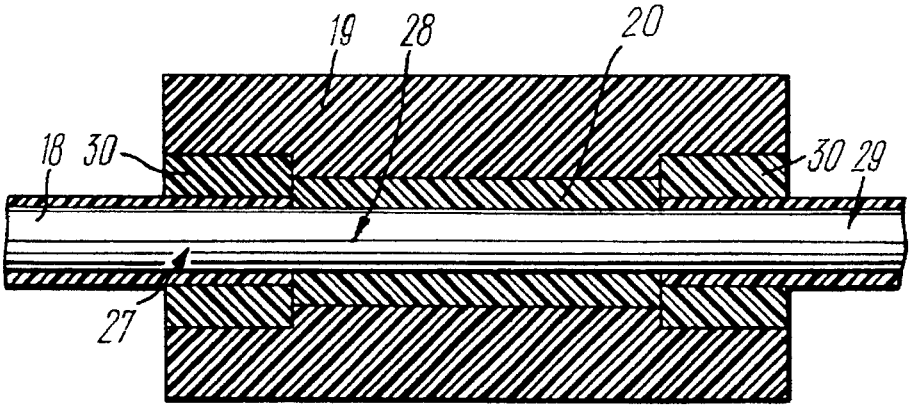
FIG. 11 is a longitudinal sectional view of an embodiment of the grounding electrode with an electrically insulating layer on a portion of the central conductor, according to the invention.

These electrode 31–33 have the structure shown in FIG. 11, but the length of sections 27 and 28 in each electrode 31–33 (FIG. 12) is different. Furthermore, an additional envelope 19' is applied on sections when section 28 of any of electrodes 31–33 in the grounding appears. Arrows 34, 35 and 36 conditionally show the protection current of different sections of the anode grounding.

The long-line electrode having sections of the central conductor 18 with an electrically insulating dielectric layer 29 consists electrically of single current-conductive elements connected in series and characterized by the longitudinal resistance of the conductor and transient resistance of the current-conductive envelope 19. These two parameters control the current distribution along the electrode and differentiation of the current yield of each element, which are determined by the ratio of the above resistances. Under condition of a constant specific resistance of the composition used for the current-conductive envelope 19 of the electrode, the possibility of controlling the electrode characteristics is attained due to the variability of the ratio of the length of the cross section of the conductor 18 in the dielectric layer 29. For example, if it is necessary to preserve the initial characteristics when the length of the section of the conductor with a dielectric layer 29 is reduced, the cross section of the conductor is reduced proportionally, or, which is the same, the diameter. If it is necessary to increase the current yield on any local grounding element without changing its length, it is necessary to increase the cross section of the conductor 18 on the corresponding section with a dielectric layer 29.

The anode grounding of such a structure operates as follows.

Figure 13:
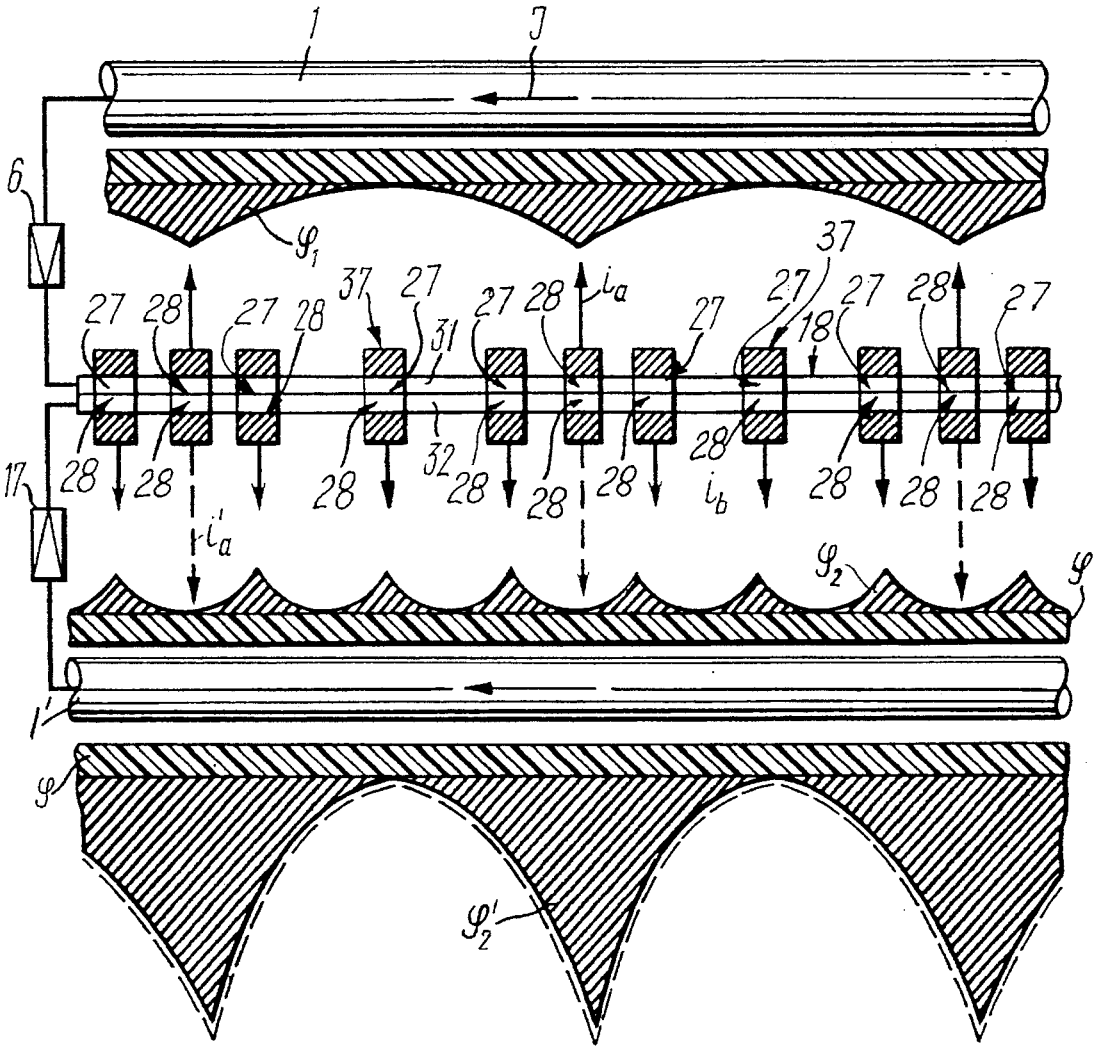
FIG. 13 is a schematic diagram of effecting the method for electric protection of a metal object, according to the invention, in which a grounding electrode with a multiple-core central conductor is used.

The long-line type anode grounding with discretely distributed electrical characteristics is disposed along the object to be protected. When the "minus" terminal of the current source 6 (FIG. 13) is connected to this object 1 and the "plus" terminal is connected to the grounding electrode, a protection current starts flowing between them. This current produces a plane-parallel field 90–95% closed within the interelectrode gap. The electric current flowing from the source 6 spreads along the conductor 18, in which the sections 27 with an electrically insulating layer 29 of the envelope 19 prevent its leakage to the ambient medium. At the same time, when the current reaches the current-conductive sections 28 of the envelope 19, it can flow through the ambient medium to the nearby object 1 to be protected with a transverse gradient of potentials. Flowing into the object 1, the current protects it from corrosive destruction, creating a required level of protective potential at the "object-medium" interface. Such propagation of current along the grounding electrode is determined by the "long line" law, i.e. electrical characteristics: the input resistance and the current propagation constant of the grounding itself. This allows such a ratio of dimensions of elements of the current-conductive sections 28 of the envelope 19 and the distance between them to be discretely selected that the electrical characteristics of the grounding become equal to or less than the similar characteristics of the object 1 to be protected. In this case, optimum ondictions of current distribution in the plane-parallel field of protection current are attained and this increases the protection efficiency and thus the operating life of the anode grounding under other equal conditions. The operational reliability of the grounding is increased due to the effect of the sleeves 30 preventing premature establishment of a direct electric contact between the current-carrying conductor 18 and the ambient medium.

The necessity for such control of the current yield of the anode grounding is especially pressing in case of protection of a large number of objects, e.g. two parallel pipelines 1 and 1' having very different transient resistances where a preset alternation of protection current leakage densities is needed. When the protection current only flows through elements 37 of the grounding electrode, a current $i_a$ flows from each element to the pipeline 1 and a current $i_a'$ flows to the pipeline 1'. To provide a required level of protection, i.e. an effective potential $\phi$, for each pipeline 1, 1', it is necessary to provide common potential diagrams $\phi_1$ and $\phi_2$ directly proportional to the total protection current consumption. If, in this case, the grounding consists of two electrodes 31 and 32 with discretely distributed current-conductive sections 28 of the envelope 19, currents $i_a$ and $i_b$ flow from these sections 28 selectively.

In this case, the currents $i_b$ provide an effective potential $\phi$(potential diagram $\phi_2$) on the pipeline 1' and the conditions of protection of the pipeline 1 remain unchanged. A comparison of the potential diagrams $\phi_2'$ and $\phi_2$ shows that the protection current consumption in the case of anode grounding with electrodes 31 and 32 is much lower and, therefore, its service life is accordingly higher under otherwise equal conditions.

The composition for the grounding electrodes includes a carbon-containing filler, a rubber-base polymer, a plasticizer and an insecticide. The components are taken in the following proportion, wt. %:

| | |
|---|---|
| carbon-containing filler | 40–80 |
| rubber-base polymer | 10–49.8 |
| plasticizer | 9–10 |
| insecticide | 0.2–1.9 |

The carbon-containing filler can for example be gas soot or finely dispersed carbon-graphite dust. Such a filler provides an electron mechanism of the first kind of current yield from the metal current-carrying core of the electrode to the electrode body. In so doing, the carbon-containing filler itself has good conductivity equal to approximately 9–35 ohm m and low anode solubility which makes it possible to considerably reduce the anode solubility of the whole composition of the anode grounding containing this filler in an amount of 40–80 wt. %.

The composition uses polychloroprene or butyl rubber or synthetic ethylene-propylene rubber as the rubber-base polymer, and butylphtalate or Vaseline oil or rubrax as the plasticizer.

The addition of a corresponding amount (10–49.8 wt. %) of rubber-base polymer, any of the aforementioned, to the composition, where it is in the proposed ratio with the carbon-containing filler, provides for high elasticity (at least 30%) in combination with low specific resistance which, taking into account the requirements for cathodic protection systems, must be up to 40–50 ohm m. The elasticity, as well as low anode solubility (0.24–0.48 kg/A year) are provided by using a plasticizer in the composition, while an enhanced service life, especially in non-sterile electrolytic media, e.g. ground, is ensured by introducing an insecticide, such as thiurams or carbamates or chlorophenols.

A change of the proportion of plasticizer and insecticide beyond the proposed limits impairs the basic properties of the composition. An increased content of the rubber-base polymer, or, which is the same, a decreased content of the carbon-containing filler, making it possible to reduce content of the plasticizer results in a drastic increase of the specific resistance of the composition. A reduced content of said binder or an increased content of the carbon-containing filler reduces the elasticity of the composition. To maintain it at the required leve, the content of the plasticizer has to be increased and this also causes the specific volumetric resistance of the composition to substantially increase.

Reduction of the content of the insecticide to a value less than 0.2% deprives the composition of antibacterial stability, while its increase to a value higher than 1.0% makes the composition toxic which is forbidden by sanitary regulations.

Thus, the proposed interrelated proportion of the components of the composition provides for three basic quantitative parameters:

| | |
|---|---|
| anode solubility | not higher than 0.24–0.48 kg/A year |
| specific resistance | not higher than 40–50 ohm m |
| elasticity | minimum 30% |

The composition for the grounding electrode is prepared as follows.

Using rolls at a temperature of 40–90° C. a rubber-base polymer is prepared, which is then supplemented with a carbon-containing filler, a plasticizer and an insecticide. At the beginning of the process of mixing the binder is plasticized for from one to five minutes. Then, after six to nine minutes, the plasticizer and insecticide are added. The carbon-containing filler is added during the 10th to 18th minute. The mixing process is completed at the 19th to 21st minute. The vulcanization is effected in an electrical press at a temperature of 140°–160° C.

Mixtures were prepared having different amounts and types of components. The data are tabulated in Table 2. The results of a study of the effect of the amount of each component on the composition properties are given in Table 3.

TABLE 2

| | Content of components, wt. % | | | | | | | |
|---|---|---|---|---|---|---|---|---|
| | | Rubber-base polymer | | | | | | |
| Item No. of composition 1 | Carbon-containing filler 2 | Polychloroprene 3 | Butyl rubber 4 | Ethylene-propylene rubber 5 | Dibutylphthalate 6 | Plasticizer Vaseline oil 7 | Rubrax 8 | Insecticide 9 |
| 1 | 40 | 49.8 | — | — | 10.0 | — | — | 0.2 |
| 2 | 40 | 49.8 | — | — | 9.5 | — | — | 0.7 |
| 3 | 40 | 49.8 | — | — | 9.2 | — | — | 1.0 |
| 4 | 40 | — | 49.8 | — | — | 10.0 | — | 0.2 |
| 5 | 40 | — | 49.8 | — | — | 9.5 | — | 0.7 |
| 6 | 40 | — | 49.8 | — | — | 9.2 | — | 1.0 |
| 7 | 40 | — | — | 49.8 | — | — | 10.0 | 0.2 |
| 8 | 40 | — | — | 49.8 | — | — | 9.5 | 0.7 |
| 9 | 40 | — | — | 49.8 | — | — | 9.2 | 1.0 |
| 10 | 60 | 29.8 | — | — | 10.0 | — | — | 0.2 |
| 11 | 60 | 29.8 | — | — | 9.5 | — | — | 0.7 |
| 12 | 60 | 29.8 | — | — | 9.2 | — | — | 1.0 |
| 13 | 60 | — | 29.8 | — | — | 10.0 | — | 0.2 |
| 14 | 60 | — | 29.8 | — | — | 9.5 | — | 0.7 |

TABLE 2-continued

| Item No. of composition 1 | Carbon-containing filler 2 | Content of components, wt. % | | | | | | |
|---|---|---|---|---|---|---|---|---|
| | | Rubber-base polymer | | | | | | |
| | | Polychloroprene 3 | Butyl rubber 4 | Ethylene-propylene rubber 5 | Dibutyl-phthalate 6 | Plasticizer Vaseline oil 7 | Rubrax 8 | Insecticide 9 |
| 15 | 60 | — | 29.8 | — | — | 9.2 | — | 1.0 |
| 16 | 60 | — | — | 29.8 | — | — | 10.0 | 0.2 |
| 17 | 60 | — | — | 29.8 | — | — | 9.5 | 0.7 |
| 18 | 60 | — | — | 29.8 | — | — | 9.2 | 1.0 |
| 19 | 80 | 10.0 | — | — | 9.8 | — | — | 0.2 |
| 20 | 80 | 10.0 | — | — | 9.4 | — | — | 0.6 |
| 21 | 80 | 10.0 | — | — | 9.0 | — | — | 1.0 |
| 22 | 80 | — | 10.0 | — | — | 9.8 | — | 0.2 |
| 23 | 80 | — | 10.0 | — | — | 9.4 | — | 0.6 |
| 24 | 80 | — | 10.0 | — | — | 9.0 | — | 1.0 |
| 25 | 80 | — | — | 10.0 | — | — | 9.8 | 0.2 |
| 26 | 80 | — | — | 10.0 | — | — | 9.4 | 0.6 |
| 27 | 80 | — | — | 10.0 | — | — | 9.0 | 1.0 |
| 28 | 60 | 29.7 | — | — | 10.0 | — | — | 0.3 |
| 29 | 60 | 30.0 | — | — | 9.2 | — | — | 0.8 |
| 30 | 60 | — | 29.7 | — | — | 10.0 | — | 0.3 |
| 31 | 60 | — | 30.0 | — | — | 9.2 | — | 0.8 |
| 32 | 60 | — | — | 29.7 | — | — | 10.0 | 0.3 |
| 33 | 60 | — | — | 30.0 | — | — | 9.2 | 0.8 |

Thiurams are used as the insecticide in compositions Nos. 1–3, 10–12, 19–21, 28, 29, carbamates are used in compositions Nos. 4–6, 13–15, 22–24, 30, 31, while chlorophenols are used in the remaining compositions.

TABLE 3

| Composition No. | Anode solubility of composition kg/A year | Specific resistance of composition, ohm m | Elasticity | Antibacterial resistance |
|---|---|---|---|---|
| 1 | 0.15 | 50 | 41 | resistant |
| 2 | 0.17 | 50 | 38 | resistant |
| 3 | 0.18 | 48 | 32 | resistant |
| 4 | 0.19 | 50 | 41 | resistant |
| 5 | 0.21 | 50 | 35 | resistant |
| 6 | 0.23 | 45 | 30 | resistant |
| 7 | 0.24 | 50 | 40 | resistant |
| 8 | 0.26 | 48 | 31 | resistant |
| 9 | 0.28 | 40 | 30 | resistant |
| 10 | 0.25 | 50 | 42 | resistant |
| 11 | 0.26 | 48 | 40 | resistant |
| 12 | 0.27 | 45 | 35 | resistant |
| 13 | 0.23 | 48 | 42 | resistant |
| 14 | 0.26 | 45 | 38 | resistant |
| 15 | 0.29 | 40 | 34 | resistant |
| 16 | 0.27 | 48 | 35 | resistant |
| 17 | 0.28 | 46 | 34 | resistant |
| 18 | 0.29 | 39 | 32 | resistant |
| 19 | 0.28 | 46 | 36 | resistant |
| 20 | 0.31 | 38 | 34 | resistant |
| 21 | 0.35 | 34 | 31 | resistant |
| 22 | 0.31 | 44 | 36 | resistant |
| 23 | 0.36 | 36 | 32 | resistant |
| 24 | 0.41 | 32 | 30 | resistant |
| 25 | 0.35 | 42 | 34 | resistant |
| 26 | 0.42 | 30 | 31 | resistant |
| 27 | 0.48 | 28 | 30 | resistant |
| 28 | 0.25 | 48 | 38 | resistant |
| 29 | 0.25 | 48 | 41 | resistant |
| 30 | 0.25 | 50 | 36 | resistant |
| 31 | 0.24 | 49 | 40 | resistant |
| 32 | 0.25 | 49 | 38 | resistant |
| 33 | 0.24 | 50 | 40 | resistant |

It is evident from Table 3 that the rate of anode solubility of the groundings made of the proposed compositions is several times less than the known one. Therefore, the use of dibutyl phthalate and rubber-base polymer of the chloroprene type as a plasticizer in the proposed proportions makes it possible to reduce the average rate of dissolving by a factor of 1.8 to 2.9, i.e. to accordingly increase the service life of the grounding electrodes made of these compositions in the same proportion. Similar use of a rubber-base polymer of the butyl rubber type and a plasticizer of the Vaseline oil type makes it possible to reduce the average rate of dissolving by a factor of 1.6 to 2.5, while the use of a rubber-base polymer of the synthetic ethylene-propylene type and a plasticizer of the rubrax type reduces the same by a factor of 1.4 to 2.2, i.e. as a whole on the average by a factor of two.

The anode solubility of practically all compositions is less than that of the prior art composition and this makes it possible to increase the life of the anode grounding electrodes made of these compositions by 10–15 years.

Introduction of the insecticide into the composition makes it resistant to bacterial destruction when the insecticide is added in an amount of minimum 0.2%.

An increase of the insecticide content above 1.0% makes the process of preparation of the composition toxic and the final products of this process are in many cases also toxic. The necessary protection measures complicate the technology of making the composition, while the practical utilization of toxic articles is prohibited by sanitary regulations.

Examples of compositions with different insecticides, i.e. thiurams, carbamates and chlorophenols are given in Table 4, in which the other components are taken in proportions corresponding to the composition number given in columns 3–8 of Table 2.

TABLE 4

| Composition No. | Thiurams | Carbamates | Chlorophenols |
|---|---|---|---|
| 1 | 0.2 | — | — |

TABLE 4-continued

| Composition No. | Thiurams | Carbamates | Chlorophenols |
|---|---|---|---|
| 2 | 0.7 | — | — |
| 3 | 1.0 | — | — |
| 4 | — | 0.2 | — |
| 5 | — | 0.7 | — |
| 6 | — | 1.0 | — |
| 7 | — | — | 0.2 |
| 8 | — | — | 0.7 |
| 9 | — | — | 1.0 |
| 10 | 0.2 | — | — |
| 11 | 0.7 | — | — |
| 12 | 1.0 | — | — |
| 13 | — | 0.2 | — |
| 14 | — | 0.7 | — |
| 15 | — | 1.0 | — |
| 16 | — | — | 0.2 |
| 17 | — | — | 0.7 |
| 18 | — | — | 1.0 |
| 19 | 0.2 | — | — |
| 20 | 0.6 | — | |
| 21 | 1.0 | — | |
| 22 | — | 0.2 | — |
| 23 | — | 0.6 | — |
| 24 | — | 1.0 | — |
| 25 | — | — | 0.2 |
| 26 | — | — | 0.6 |
| 27 | — | — | 1.0 |
| 28 | 0.3 | — | — |
| 29 | 0.8 | — | — |
| 30 | — | 0.3 | — |
| 31 | — | 0.8 | — |
| 32 | — | — | 0.3 |
| 33 | — | — | 0.8 |

To improve the composition, it is provided with a structure stabilizer in an amount of up to 10 wt. % of the rubber-base polymer. If the amount of the structure stabilizer exceeds 10 wt. %, the composition does not satisfy the permissible lower elasticity limit, and therefore the mechanical properties of the electrodes deteriorate and their service life is reduced.

A mixture of chlorides of magnesium and calcium or silica gel or calcined magnesia is used as the structure stabilizer. Examples of compositions with a structure stabilizer, whose amount is selected relative to one of said rubber-base polymers, are summarized in Table 5. The other components are taken in amounts given in Table 2 for the respective composition number.

TABLE 5

| Item No. of composition | Rubber-base polymer | | | Structure stabilizer | | |
|---|---|---|---|---|---|---|
| | polychloroprene | buty rubber | ethylene-propylene rubber | mixture of chlorides of magnesium and calcium | silica gel | calcined magnesia |
| 1 | 45.27 | — | — | 4.52 | — | — |
| 2 | 45.27 | — | — | 4.52 | — | — |
| 3 | 45.27 | — | — | 4.52 | — | — |
| 4 | — | 45.27 | — | — | 4.52 | — |
| 5 | — | 45.27 | — | — | 4.52 | — |
| 6 | — | 45.27 | — | — | 4.52 | — |
| 7 | — | — | 45.27 | — | — | 4.52 |
| 8 | — | — | 45.27 | — | — | 4.52 |
| 9 | — | — | 45.27 | — | — | 4.52 |
| 10 | 27.091 | — | — | 2.71 | — | — |
| 11 | 27.091 | — | — | 2.71 | — | — |
| 12 | 27.091 | — | — | 2.71 | — | — |

TABLE 5-continued

| Item No. of composition | Rubber-base polymer | | | Structure stabilizer | | |
|---|---|---|---|---|---|---|
| | polychloroprene | buty rubber | ethylene-propylene rubber | mixture of chlorides of magnesium and calcium | silica gel | calcined magnesia |
| 13 | — | 27.09 | — | — | 2.71 | — |
| 14 | — | 27.09 | — | — | 2.71 | — |
| 15 | — | 27.09 | — | — | 2.71 | — |
| 16 | — | — | 27.1 | — | — | 2.71 |
| 17 | — | — | 27.1 | — | — | 2.71 |
| 18 | — | — | 27.1 | — | — | 2.71 |
| 19 | 10.0 | — | — | 1.0 | — | — |
| 20 | 10.0 | — | — | 1.0 | — | — |
| 21 | 10.0 | — | — | 1.0 | — | — |
| 22 | — | 10.0 | — | — | 1.0 | — |
| 23 | — | 10.0 | — | — | 1.0 | — |
| 24 | — | 10.0 | — | — | 1.0 | — |
| 25 | — | — | 10.0 | — | — | 1.0 |
| 26 | — | — | 10.0 | — | — | 1.0 |
| 27 | — | — | 10.0 | — | — | 1.0 |
| 28 | 27.0 | — | — | 2.7 | — | — |
| 29 | 27.0 | — | — | 2.7 | — | — |
| 30 | — | 27.0 | — | — | 2.7 | — |
| 31 | — | 27.0 | — | — | 2.7 | — |
| 32 | — | — | 27.0 | — | — | 2.7 |
| 33 | — | — | 27.0 | — | — | 2.7 |

In compositions Nos. 19–27 the carbon containing filler is taken in an amount of 79 wt. %.

Table 6 presents some physical characteristics of grounding electrodes with compositions used containing the polymers given in Tables 2–5.

TABLE 6

| Composition No. | Anode solubility of composition kg/A year | Specific resistance, ohm m | Elasticity, % | Operating stability of resistance, % | Anti-bacterial resistance |
|---|---|---|---|---|---|
| 1 | 0.15 | 50 | 41 | 80 | resistant |
| 2 | 0.17 | 50 | 38 | 85 | resistant |
| 3 | 0.18 | 48 | 32 | 95 | resistant |
| 4 | 0.19 | 50 | 41 | 80 | resistant |
| 5 | 0.21 | 50 | 35 | 85 | resistant |
| 6 | 0.23 | 45 | 30 | 95 | resistant |
| 7 | 0.24 | 50 | 41 | 80 | resistant |
| 8 | 0.26 | 48 | 31 | 85 | resistant |
| 9 | 0.28 | 40 | 30 | 95 | resistant |
| 10 | 0.25 | 50 | 42 | 80 | resistant |
| 11 | 0.26 | 48 | 40 | 85 | resistant |
| 12 | 0.27 | 45 | 35 | 95 | resistant |
| 13 | 0.23 | 48 | 42 | 80 | resistant |
| 14 | 0.26 | 45 | 38 | 85 | resistant |
| 15 | 0.29 | 40 | 34 | 95 | resistant |
| 16 | 0.27 | 48 | 35 | 80 | resistant |
| 17 | 0.28 | 46 | 34 | 85 | resistant |
| 18 | 0.29 | 39 | 32 | 95 | resistant |
| 19 | 0.28 | 46 | 36 | 80 | resistant |
| 20 | 0.31 | 38 | 34 | 85 | resistant |
| 21 | 0.39 | 34 | 31 | 95 | resistant |
| 22 | 0.31 | 44 | 46 | 80 | resistant |
| 23 | 0.36 | 36 | 32 | 85 | resistant |
| 24 | 0.41 | 32 | 30 | 95 | resistant |
| 25 | 0.35 | 42 | 34 | 80 | resistant |
| 26 | 0.42 | 30 | 31 | 85 | resistant |
| 27 | 0.48 | 28 | 30 | 95 | resistant |
| 28 | 0.25 | 48 | 38 | 85 | resistant |
| 29 | 0.25 | 48 | 41 | 95 | resistant |
| 30 | 0.25 | 50 | 36 | 85 | resistant |

TABLE 6-continued

| Composition No. | Anode solubility of composition kg/A year | Specific resistance, ohm m | Elasticity, % | Operating stability of resistance, % | Anti-bacterial resistance |
|---|---|---|---|---|---|
| 31 | 0.24 | 49 | 40 | 95 | resistant |
| 32 | 0.25 | 49 | 38 | 85 | resistant |
| 33 | 0.24 | 50 | 40 | 95 | resistant |

Therefore, the claimed composition for the grounding electrodes features technological advantages and has high elasticity and low specific resistance, as well as high resistance to anode dissolving and against bacterial destruction. This makes it possible to reduce the number and to increase the effective service life of such electrodes in anode groundings on the average by 100%. This is very important since with electrochemical protection of underground structures against corrosion, the installation and replacement of anode groundings constitute the main part of the building expenses.

INDUSTRIAL APPLICABILITY

The invention can be used in systems of anti-corrosion cathodic protection of extended metal structures such as main pipelines, as well as for electrical protection of metal objects, including objects of complex shape, against external voltages.

We claim:

1. A grounding electrode for electrically protecting a metal object, comprising:

(a) a central elongate flexible metal conductor having successive first and second axial sections, (b) an envelope, made of a flexible electrically conductive polymeric material, surrounding a portion of the central conductor, (c) an insulating layer surrounding part of the central conductor, (d) a layer of conductive adhesive, and (e) a sleeve of dielectric material;

the conductive polymeric envelope being positioned to surround said first and second sections of said central metal conductor;

the layer of conductive adhesive being positioned between the central conductor and the conductive polymeric envelope in said first section of the grounding electrode; and said sleeve of dielectric material being positioned around said insulating layer within the conductive polymeric envelope of said second section of the central conductor and forming a monolithic joint with said envelope.

2. A grounding electrode according to claim 1, characterized in that the conductive polymeric envelope consists of two layers and the elctrical conductivity of the layers is selected to be different.

3. A grounding electrode according to claim 2, characterized in that the conductive polymeric envelope has electrical parameters varying along the length of the electrode.

4. A grounding electrode according to claim 3, characterized in that the conductive adhesive layer has electrical parameters varying along the length of the electrode.

5. A grounding electrode according to claim 4, characterized in that the central conductor is a multiple-core conductor surrounded by a common adhesive layer.

6. A grounding electrode according to claim 1, characterized in that the conductive polymeric envelope has electrical parameters varying along the length of the electrode.

7. A grounding electrode according to claim 1, characterized in that the conductive adhesive layer has electrical parameters varying along the length of the electrode.

8. A grounding electrode according to claim 1, characterized in that the central conductor is a multiple-core conductor surrounded by a common-adhesive layer.

9. A grounding electrode according to claim 1, characterized in that the central conductor is a multiple-core conductor comprising a plurality of wires, and a conductive adhesive layer encompasses each of the wires of the multiple-core conductor.

10. A grounding electrode according to claim 1, wherein said central conductor is a multiple core conductor comprising a plurality of wires.

11. A grounding electrode according to claim 10, characterized in that for at least one wire the ratio of the length of the section provided with an electrically insulating layer to the cross-sectional area of the wire in this section is so selected that the said ratio varies along the length of the grounding electrode.

* * * * *